US009375599B1

(12) United States Patent
Simmons

(10) Patent No.: US 9,375,599 B1
(45) Date of Patent: Jun. 28, 2016

(54) ASSISTED APPARATUS FOR LOWER BACK EXERCISE

(71) Applicant: Tee and Ell Weight Lifting and Exercise Enterprises, Inc., Columbus, OH (US)

(72) Inventor: Louis J Simmons, Columbus, OH (US)

(73) Assignee: Tee and Ell Weight Lifting and Exercise Enterprises, Inc., Columbus, OH (US)

( * ) Notice: Subject to any disclaimer, the term of this patent is extended or adjusted under 35 U.S.C. 154(b) by 0 days.

(21) Appl. No.: 14/629,672

(22) Filed: Feb. 24, 2015

(51) Int. Cl.

| | |
|---|---|
| ***A63B 21/008*** | (2006.01) |
| ***A63B 24/00*** | (2006.01) |
| ***A63B 23/08*** | (2006.01) |
| ***A63B 26/00*** | (2006.01) |

(Continued)

(52) U.S. Cl.
CPC ..... *A63B 21/0085* (2013.01); *A63B 21/00047* (2013.01); *A61H 1/0237* (2013.01); *A63B 21/008* (2013.01); *A63B 21/0058* (2013.01); *A63B 21/0083* (2013.01); *A63B 21/0087* (2013.01); *A63B 21/00181* (2013.01); *A63B 21/4013* (2015.10); *A63B 21/4047* (2015.10)

(58) Field of Classification Search
CPC . A61H 1/0237; A61H 1/0255; A61H 1/0266; A63B 21/005; A63B 21/0058; A63B 21/008; A63B 21/0083; A63B 21/0085; A63B 21/0087; A63B 21/00181; A63B 21/1609; A63B 21/4013; A63B 21/4034; A63B 21/4047; A63B 23/02; A63B 23/0233; A63B 23/0482; A63B 23/0494
USPC ..... 482/112
See application file for complete search history.

(56) References Cited

U.S. PATENT DOCUMENTS 4,226,415 A * 10/1980 Wright ..... A63B 23/03525 482/113
4,227,689 A * 10/1980 Keiser ..... A63B 1/0087 482/113

(Continued)

FOREIGN PATENT DOCUMENTS

WO 2008152627 A2 12/2008
WO 2013102760 A1 7/2013

OTHER PUBLICATIONS http://www.marinecargoclaimsinc.com/inventory/corevolution-exercise-machine/.

(Continued)

*Primary Examiner* — Oren Ginsberg
*Assistant Examiner* — Joshua Lee
(74) *Attorney, Agent, or Firm* — John A. Thomas

(57) ABSTRACT

An apparatus for lower back exercise has a support structure, a body support platform and a pendulum pivotably connected to the support structure below the body support platform for engaging the legs of a user. Actuators cause the pendulum to move upwardly or downwardly to either assist the movement of the legs of a user engaging the pendulum, or to resist motions of the pendulum initiated by the user. The body support platform may be tilted by an actuator to provide ease of mounting and dismounting the apparatus. Controls for the actuators are provided to allow a practitioner to monitor and adjust the assistance or resistance provided by the apparatus to the user. The apparatus thus avoids hyperextension of the back while providing strength conditioning with progressive intensity of work outs, especially for users injured or otherwise in poor condition.

19 Claims, 12 Drawing Sheets

(51) Int. Cl.

| | |
|---|---|
| ***A63B 21/00*** | (2006.01) |
| *A63B 21/005* | (2006.01) |
| *A61H 1/02* | (2006.01) |

(56) References Cited

U.S. PATENT DOCUMENTS

| | | | | | |
|---|---|---|---|---|---|
| 4,247,098 | A | | 1/1981 | Brentham | |
| 4,254,949 | A | * | 3/1981 | Brentham | A63B 23/03516 482/112 |
| 4,363,481 | A | | 12/1982 | Erickson | |
| 4,429,871 | A | * | 2/1984 | Flechner | A63B 23/0355 482/112 |
| 4,441,708 | A | * | 4/1984 | Brentham | A63B 23/03516 482/112 |
| 4,448,412 | A | * | 5/1984 | Brentham | A63B 21/0083 188/285 |
| 4,566,692 | A | * | 1/1986 | Brentham | A63B 21/0083 482/113 |
| 4,848,739 | A | * | 7/1989 | Schaub | A63B 21/00072 482/113 |
| 5,015,926 | A | | 5/1991 | Casler | |
| 5,031,905 | A | * | 7/1991 | Walsh | A63B 21/00072 482/112 |
| 5,094,445 | A | * | 3/1992 | Winkelvoss | A61H 1/0229 482/111 |
| 5,181,895 | A | | 1/1993 | Larson et al. | |
| 5,356,359 | A | | 10/1994 | Simmons | |
| 5,498,222 | A | * | 3/1996 | Hur | A63B 21/055 482/112 |
| 5,913,759 | A | * | 6/1999 | Bostrom | A61H 1/0255 482/131 |
| 6,387,024 | B1 | * | 5/2002 | Monti | A63B 21/00072 482/130 |
| 6,491,607 | B2 | | 12/2002 | Simmons | |
| 6,652,430 | B2 | | 11/2003 | Lapcevic | |
| 7,445,586 | B2 | * | 11/2008 | Gibson | A47C 7/503 482/142 |
| 7,473,212 | B2 | | 1/2009 | Simmons | |
| 7,695,416 | B2 | * | 4/2010 | Weiner | A61H 1/024 482/112 |
| 7,699,763 | B2 | | 4/2010 | Perry | |
| 7,780,584 | B2 | * | 8/2010 | Alexander | A47C 7/62 482/112 |
| 7,806,813 | B2 | | 10/2010 | Campitelli | |
| 7,914,425 | B2 | | 3/2011 | Hanoun | |
| 7,976,439 | B2 | | 7/2011 | Abelbeck | |
| 8,007,421 | B2 | | 8/2011 | Goel et al. | |
| 8,016,731 | B2 | | 9/2011 | Vanterpool | |
| 8,177,695 | B2 | | 5/2012 | Dellino | |
| 8,413,572 | B1 | | 4/2013 | Langenfeld et al. | |
| 8,425,384 | B2 | | 4/2013 | Garner | |
| 8,465,403 | B2 | | 6/2013 | Mccall | |
| 8,491,506 | B2 | | 7/2013 | Smyrk et al. | |
| 8,529,413 | B2 | | 9/2013 | Simmons | |
| 9,211,431 | B2 | * | 12/2015 | Hornback | A63B 21/068 |
| 2002/0193710 | A1 | * | 12/2002 | Main | A61H 1/0266 601/5 |
| 2006/0003873 | A1 | | 1/2006 | Kobayashi | |
| 2007/0111861 | A1 | * | 5/2007 | Nativ | A63B 21/0552 482/51 |
| 2007/0219072 | A1 | * | 9/2007 | Kessler | A63B 21/4047 482/112 |
| 2009/0098984 | A1 | * | 4/2009 | Smyrk | A61H 1/0244 482/72 |
| 2012/0165168 | A1 | * | 6/2012 | Simmons | A63B 21/0615 482/139 |
| 2015/0051520 | A1 | * | 2/2015 | Donohue | A61H 1/005 601/35 |

OTHER PUBLICATIONS http://www.ironcompany.com/reversehyperultra.aspx#.U5kPJI1dWEg.

http://www.roguefitness.com/rh-2m-rogue-hyper-3x3-mount.

* cited by examiner

ASSISTED APPARATUS FOR LOWER BACK EXERCISE

BACKGROUND

1. Technical Field

This disclosure relates to an improved apparatus and method for lower back exercise.

2. Background

Back muscle and cartilage injuries, especially in the lower lumbar region of the back, are relatively common. Such injuries are especially common in individuals who, for one reason or another, have failed to maintain the conditioning and tone of the muscles that support the lower back. These muscles, the spinal erectors and hip flexors must be maintained in reasonable condition if such muscle and cartilage injuries are to be protected against.

Additionally, once injury has occurred, healing can be promoted by increasing the flow of blood to the injured muscles and the areas surrounding the injury. Unfortunately, the number and density of blood vessels in the lower back area is relatively low. However, exercise is believed by many to stimulate increased blood flow. A drawback to most forms of exercise is the risk or tendency of hyperextension of the already injured muscles thereby aggravating the injury rather than promoting healing of the muscles, cartilage and surrounding tissues.

U.S. Pat. No. 5,356,359, to Applicant Louis J. Simmons attempts to address these needs. The present application is an improvement over the apparatus disclosed in U.S. Pat. No. 5,356,359, as well as over the apparatus disclosed in Applicant's U.S. Pat. Nos. 8,529,413 and 6,491,607, all of which patents are incorporated into the present disclosure by reference in their entirety, but which are not admitted to be prior art by inclusion in this Background section. However, none of the previous attempts have completely met the exercise needs of individuals who have already sustained lower back injuries or whose lower back areas are too out-of-condition to be able to withstand rigorous exercise. In order for exercise to be of value, it must progressively increase in intensity. A common method of increasing the intensity of an exercise is through the use of increased resistance from static weight additions. However, adding weight to an exercise can increase the hyperextension of lower back muscles. Therefore, weight training is not generally recommended for those suffering from lower back muscle, tissue and cartilage injuries.

There is a need for an exercise apparatus that avoids hyperextension of lower back muscles while providing for conditioning and muscle tone, and which can increase local blood circulation to injured muscles and tissues in the lower back. There is also a need for an exercise apparatus that can permit progressive intensity of the workout to strengthen lower back muscles and tissues and provide increased blood flow to those areas, without increasing the hyperextension of lower back muscles. For persons not in good physical condition, there is a particular need for an apparatus that can assist the person with performance of the exercise, while still retaining the benefits of lower-back muscle conditioning.

SUMMARY

An apparatus for lower back exercise comprises a support structure, and the support structure further comprises a body support platform. A pendulum is pivotably connected to the support structure and hangs down therefrom. Thus the pendulum has a vertical plane of movement with respect to the support structure. A resistance transfer apparatus is pivotably connected to the pendulum. The resistance transfer apparatus pivots in a plane substantially parallel to the plane of movement of the pendulum while it is engaging the legs of a user exercising. At least one first actuator is connected to the pendulum to cause the pendulum to move upwardly or downwardly in its plane of movement to assist the movement of the legs of the user engaging the pendulum at the resistance transfer apparatus. A second actuator is connected to the pendulum to cause the pendulum to move upwardly or downwardly to exert resistance to movement of the user's legs initiated by the user. Controls are operably connected to the actuators effective to regulate the motion of the pendulum upwardly or downwardly while the user's body is disposed on the body support platform and the user's legs engage the pendulum. The actuators may be pneumatic, hydraulic, or electric, or some combination thereof. Controls for the actuators allow a practitioner to monitor and adjust the assistance or resistance provided by the apparatus to the user. The apparatus thus avoids hyperextension of the back while providing strength conditioning with progressive intensity of work outs, especially for users injured or otherwise in poor condition.

DRAWINGS

Non-limiting embodiments of the present disclosure are described by way of example in the following drawings, which are schematic and are not intended to be drawn to scale:

DETAILED DESCRIPTION

The present disclosure is a novel improvement over the machines disclosed in the patents cited above in the Background Section and incorporated herein by reference (called "the incorporated patents"). The incorporated patents show embodiments of machines manufactured by Tee and Ell Weight Lifting and Exercise Enterprises, Inc., of Columbus, Ohio, and sold under the trademark REVERSE HYPER®.

In this application, the term "user" refers to the person who is engaging his or her body with the disclosed apparatus and using it for performance of exercises to strengthen and condition the muscles of the lower back.

Figure 1A:
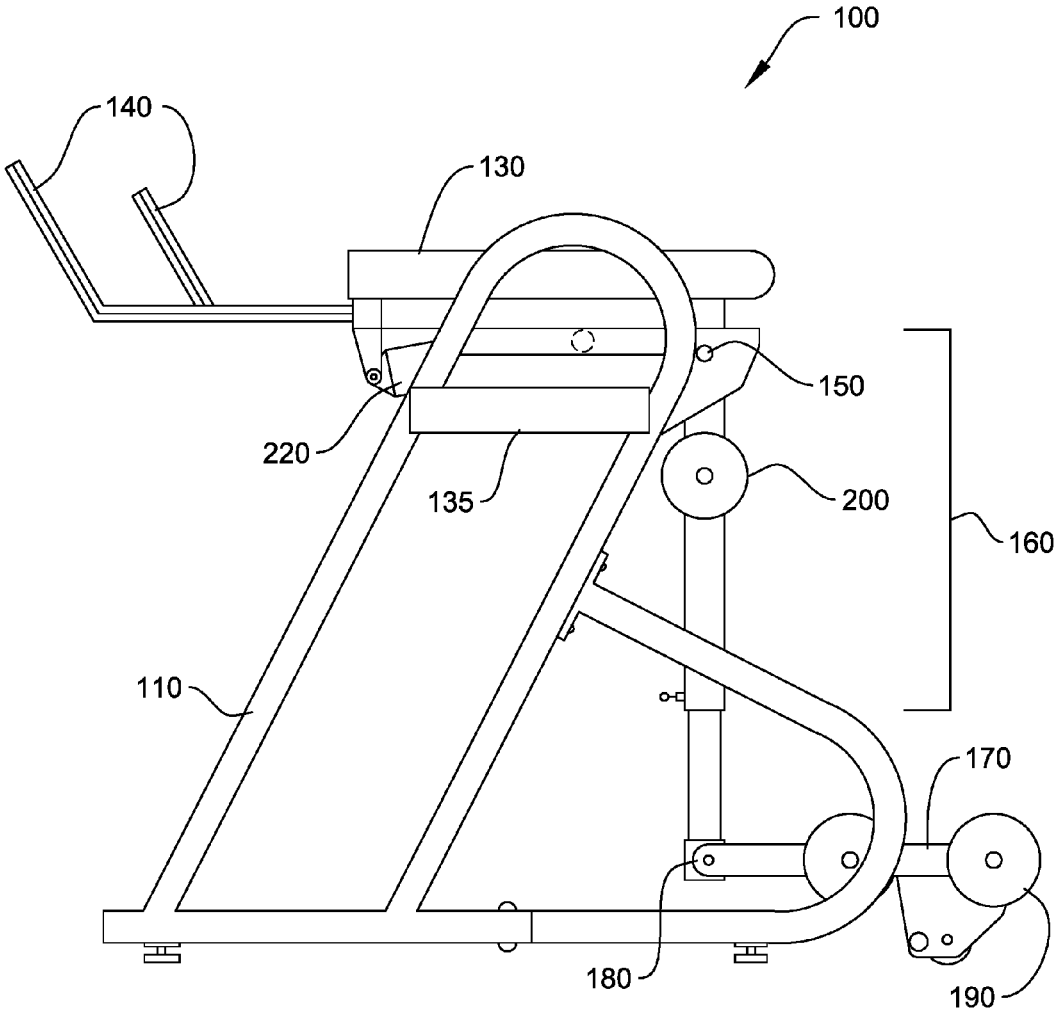
FIG. 1A is a side view of an embodiment of the disclosed apparatus.
Figure 1B:
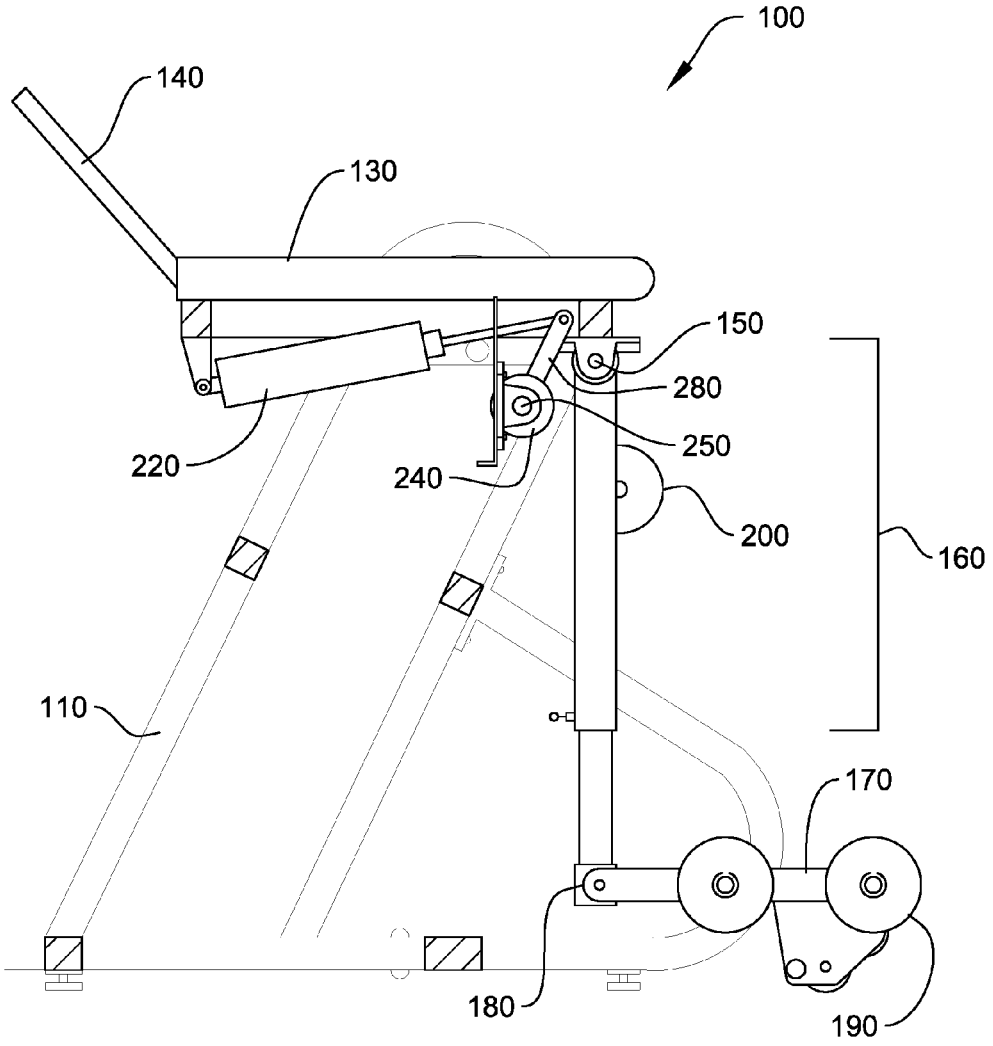
FIG. 1B is a side view of an embodiment of the disclosed apparatus showing a means for applying assistance and resistance to the pendulum of the apparatus.
Figure 1C:
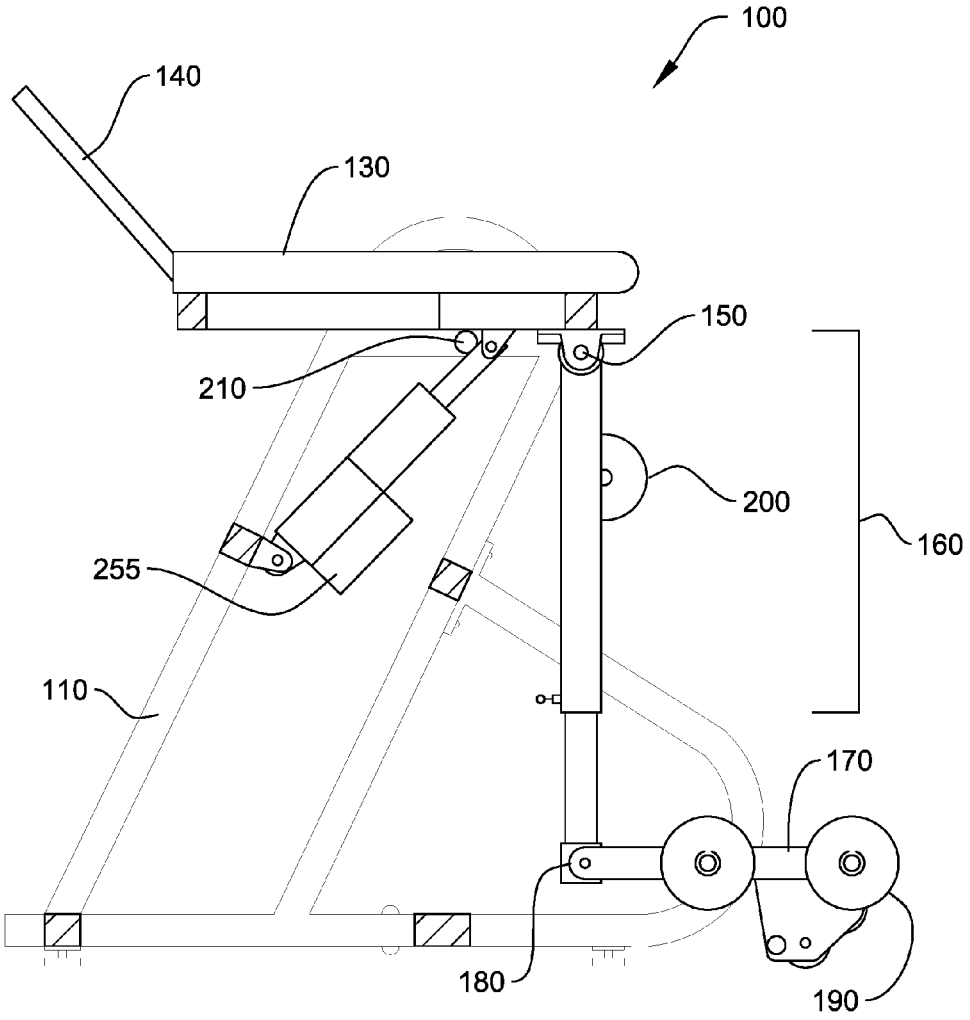
FIG. 1C is a further side view of an embodiment of the disclosed apparatus, showing a means for tilting the body support platform.
Figure 2:
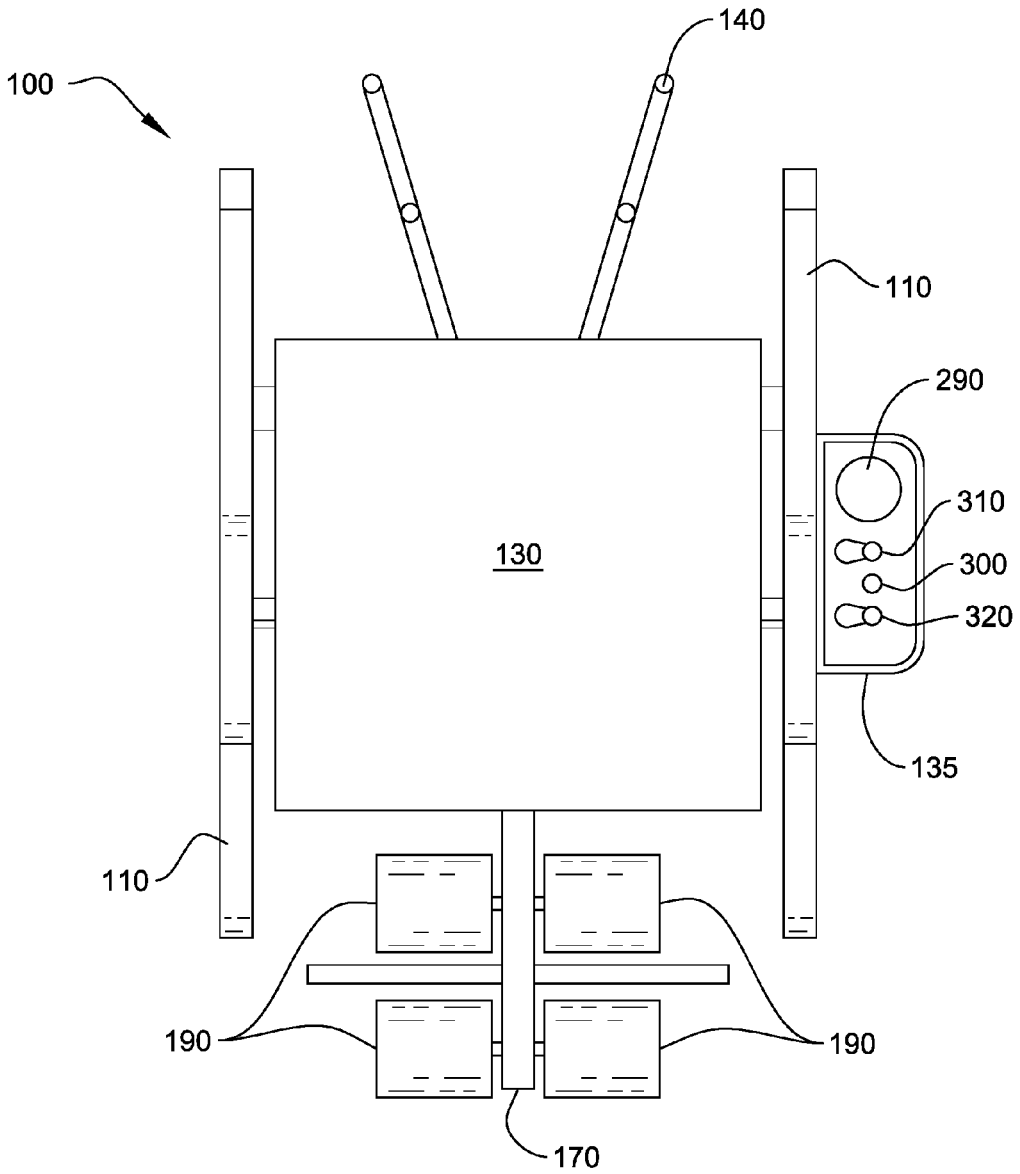
FIG. 2 is a top view of an embodiment of the disclosed apparatus.
Figure 3:
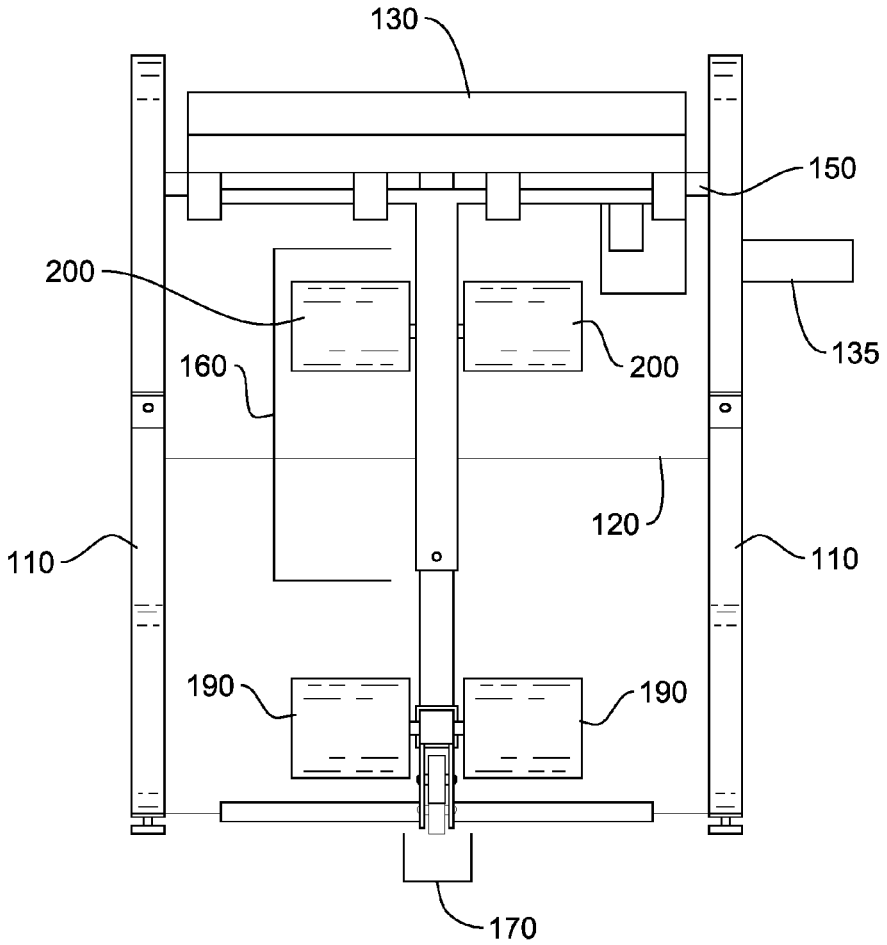
FIG. 3 is a rear view of an embodiment of the disclosed apparatus.

FIGS. 1 through 3 show an embodiment 100 of the improved apparatus. FIGS. 1A and 1B are side views, FIG. 2 is a rear view, and FIG. 3 is a top view. Generally, support legs 110 are connected by support cross arms 120 (see FIG. 3), and body support platform 130 to form a user support structure. A pendulum 160, described below, depends from the user support structure. It is preferred that the body support platform 130 include padding for comfort. Handholds 140 for the user may optionally be provided.

FIG. 1A shows means for providing assistance and resistance to the pendulum 160, as discussed in detail below. For clarity, the side view of FIG. 1B omits the foregoing means from the depiction, and shows the support-platform actuator 255, discussed in more detail below. FIG. 1A omits depiction of the support-platform actuator 255.

FIG. 3 shows a pivot bar 150, located below the body support platform 130, that rotatably retains the pendulum 160. For optimal implementation of the exercise method, the pivot bar 150 should be located at a point approximately below the waist of the person using the apparatus and at a vertical position near the body support platform 130.

The pendulum 160 is rotatably retained on the pivot bar 150 on one or more bearings 155 fitted to the pivot bar 150. The bearings 155 may be equivalently mounted on support cross arms 120 or elsewhere on the supporting structure to thereby rotatably retain the pivot bar 150. In any embodiment, pendulum 160 is then freely pivotable about the pivot bar 150, as shown, in a substantially vertical plane.

The pendulum 160, as illustrated in FIGS. 1 and 3, is a composite structure. A resistance transfer apparatus 170 is pivotably attached to the pendulum 160 at a connector 180. The resistance transfer apparatus 170, as shown in FIGS. 1-3, preferably has two or more pads 190 extending laterally from the axis of the resistance transfer apparatus 170, which pads 190 are preferably rotatably mounted, to thus comfortably retain the user's ankles as the exercise is executed. The resistance transfer apparatus 170 may retain the user's legs anywhere along their length, but the optimum position is at the ankles, as shown in FIGS. 7-10. It is convenient to provide additional padded supports 200 along the pendulum 160, but nearer the pivot bar 150, to give additional support to the user's upper legs.

As stated, many individuals, however, cannot perform the exercise without assistance. Such persons require an assisted lift of the legs, at least for the concentric portion of the lift. Users unable to lift their legs up can still go through the complete range of motion with the assistance. The eccentric portion of the movement, or the lowering of the legs, may be assisted by decreasing the assist provided for raising the legs in the concentric portion of the exercise. As will be discussed in more detail below, the provision of assistance to the user prevents the buildup of momentum as well as assisting out-of condition users to enter and complete the exercise. Also as discussed below, the range of motion is controlled by a practitioner and not by the user.

Figure 4:
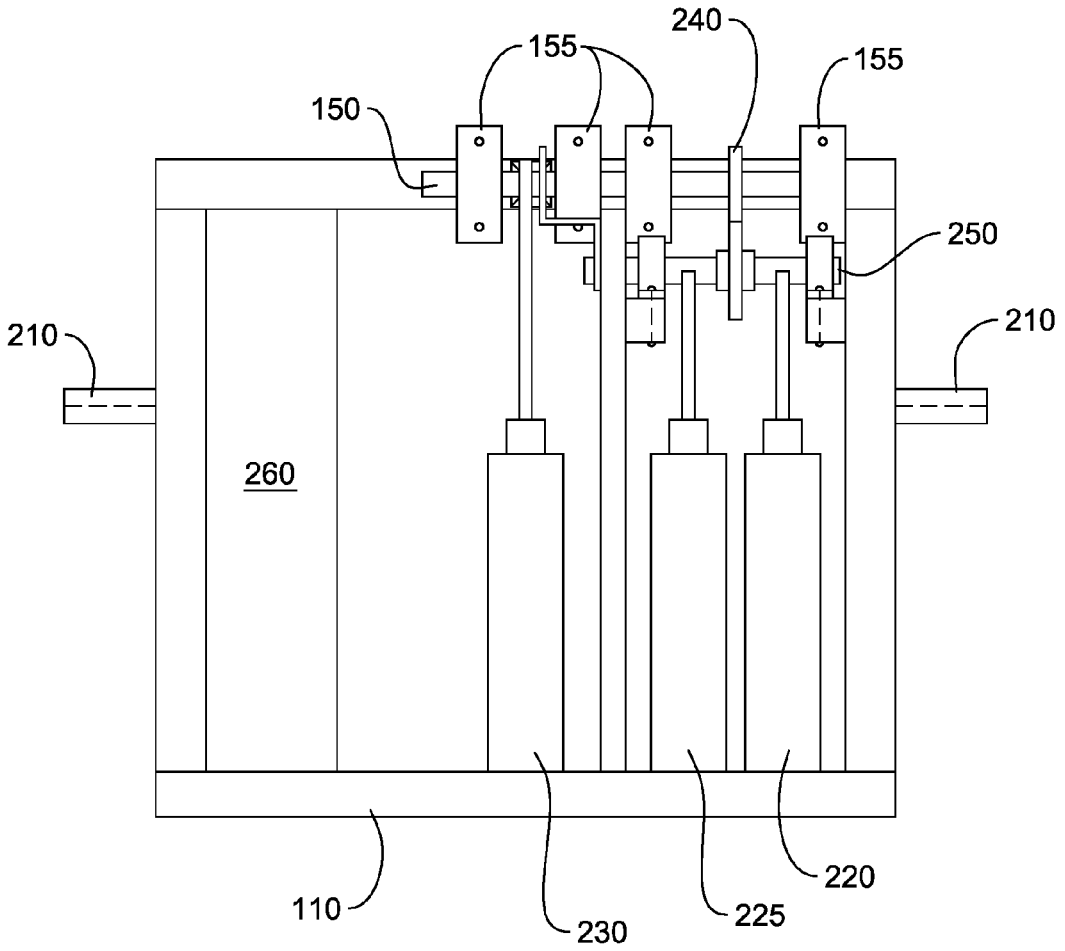
FIG. 4 is a top view of an embodiment of the disclosed apparatus, with the body support platform removed for clarity.

FIG. 4 is a top view of the prototypical embodiment 100, with the body support platform 130 removed for clarity to show the means for moving the pendulum 160. The body support platform 130 may pivot, as will be explained later, on body support rods 210 extending from either side of the frame 110. FIG. 4 further shows a control station 135 for controlling the motions of the pendulum 160, as discussed below.

Figure 5A:
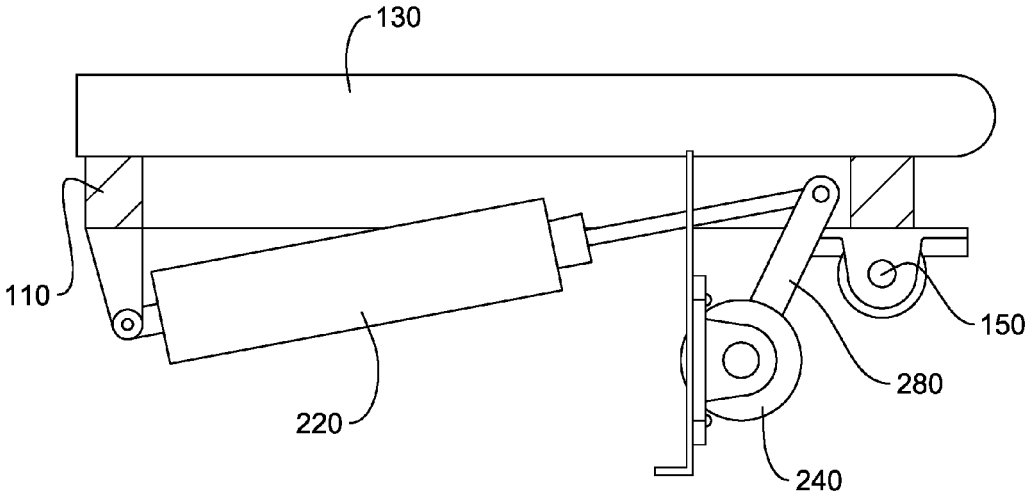
FIG. 5A is a side view of the detail of the actuator mechanism of an embodiment of the disclosed apparatus.

As further shown in FIG. 4, a first actuator 220 and second actuator 225, cooperating together, provide assistance to the user in raising and lowering the user's legs, and a third actuator 230 provides resistance to the movements made by the user. First actuator 220 and second actuator 225 turn a gear set 240 with a crank arm 280 (shown in side view FIG. 5A). Equivalently, the gear set 240 could be a sprocket and chain. The gear set 240 rotates the pivot bar 150, causing the pendulum 160 to move accordingly. The actuators 220, 225, and 230 will be discussed in this disclosure as pneumatic, but may equivalently be electric or hydraulic. The embodiment illustrated uses two actuators, first actuator 220 and second actuator 225, to obtain the force required to provide active assistance to the user. The reader should note, however, that in other embodiments only one such actuator 220, 225 for assistance will be needed, if a sufficiently powerful single actuator is adaptable to be mounted within the apparatus 100. Also, the side view figures here will generally identify only first actuator 220 for clarity.

Figure 5B:
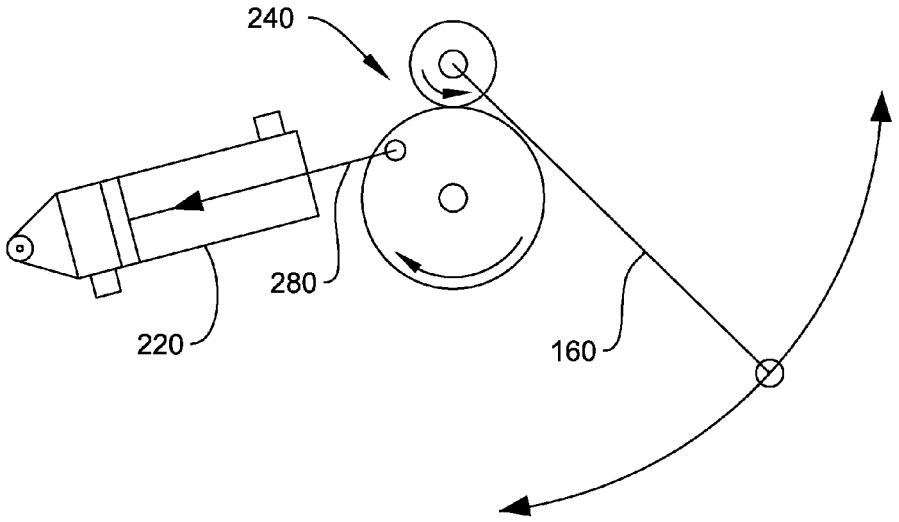
FIG. 5B is a schematic diagram of the forces exerted by the actuators of the disclosed apparatus.

FIG. 5B shows schematically the forces exerted by the first actuator 220 and second actuator 225 (or, alternatively, a single such actuator) on the pendulum 160 through the gear set 240. Since the user's legs are constrained by the resistance transfer apparatus 170 connected to the pendulum 160, the user's legs may either be assisted in their movement by the first actuator 220 and second actuator 225, or their movement may resisted by movement of the third actuator 230, depending on the pneumatic pressures communicated to the actuators 220, 225 according to settings made at the control panel 135.

The disclosed improvements safely and effectively provide exercise benefits to those users who lack the strength or control to perform the exercise on their own, without assistance. This is accomplished by providing active assistance to the movement of the user's legs and back through all phases of the exercise. The active assistance is provided for raising the pendulum 160 with the user's legs engaged by means of the first actuator 220 and second actuator 225, acting together upon the gear set 240, turning pivot bar 150.

Figure 6:
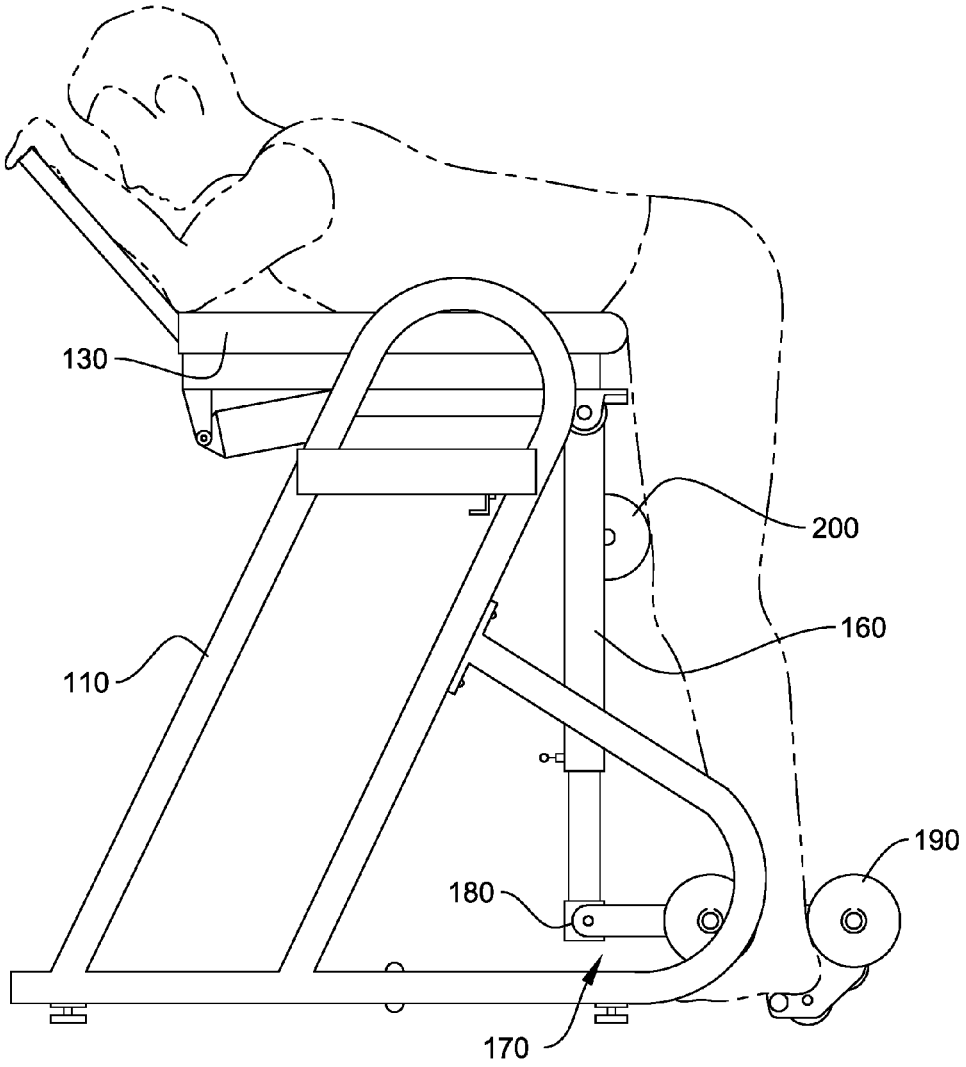
FIGS. 6 through 10 show cycles of exercise using an embodiment of the disclosed apparatus.

The active resistance to the user's movements as the user attempts to move his legs back to the starting position shown in FIG. 6, is provided by third actuator 230, also connected to turn pivot bar 150. Generally, the third actuator 230 will be sufficiently powerful to provide the needed resistance without transmission of torque through a gear set. The first actuator 220 and the second actuator 225 (or a single such actuator), and the third actuator 230 are controlled by pneumatic valves (or hydraulic valves or electric motor controls in other embodiments) preferably located in a control station 135 adjacent to or connected to the frame 110 of the apparatus 100. Preferably, the control station 135 is operated by a practitioner, such as a physician or a physical therapist.

FIG. 2 shows a top view of the controls located on a representative control panel 135. An air pressure gauge 290 shows the amount of pressure applied to the actuators, and thus the amount of force exerted by the actuators, to allow the practitioner to note and record progress by the user in both lifting his or her legs and in applying resistance. A command switch 300 is provided to command either up or down movement of the pendulum 160. A first lever switch 310 continuously varies the amount of pressure (and thus force) causing assisted movement (up or down), and a second lever switch 320 continuously varies the amount of pressure (and thus force) causing resistance to movement (up or down).

Figure 7:
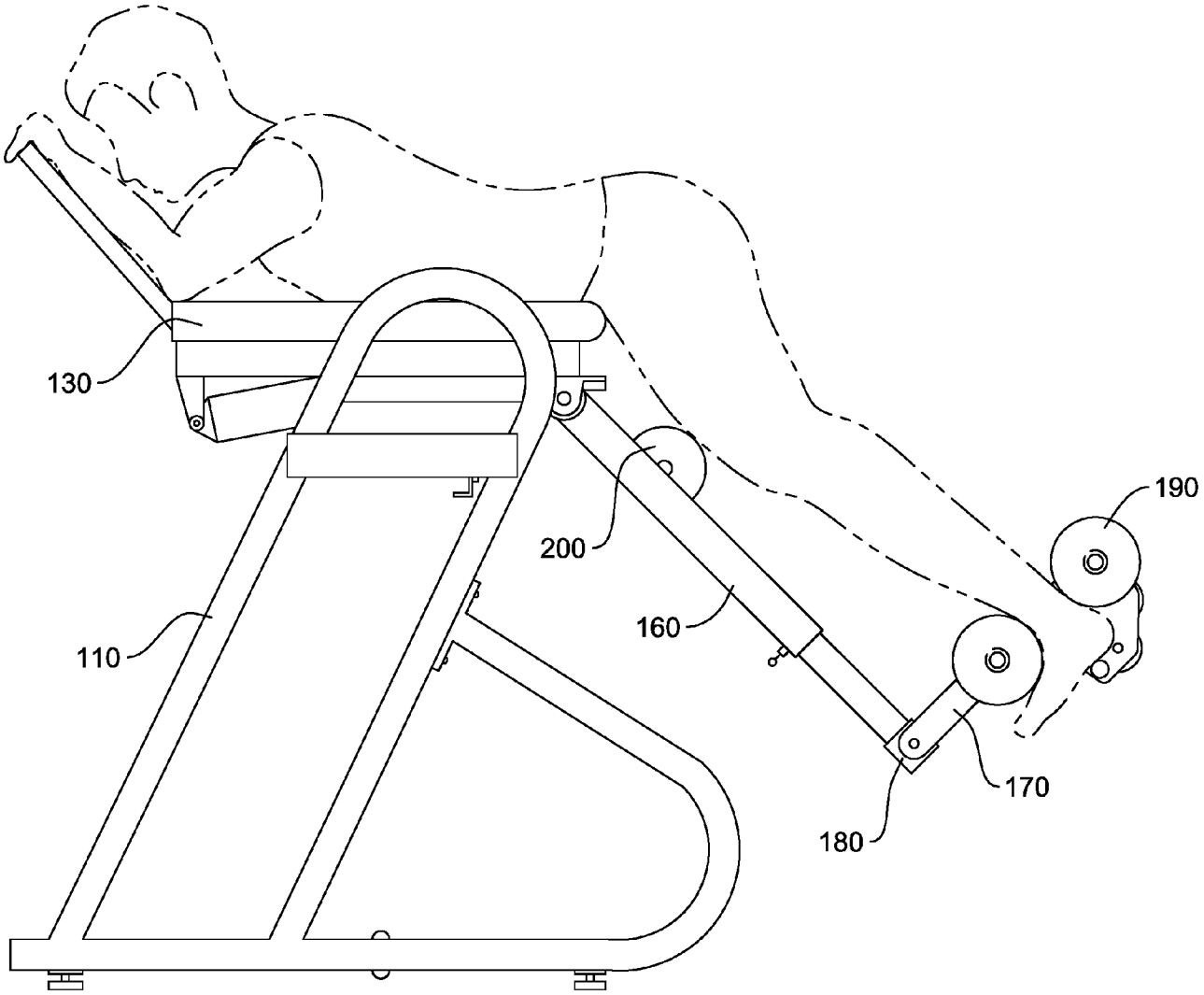
Figure 8:
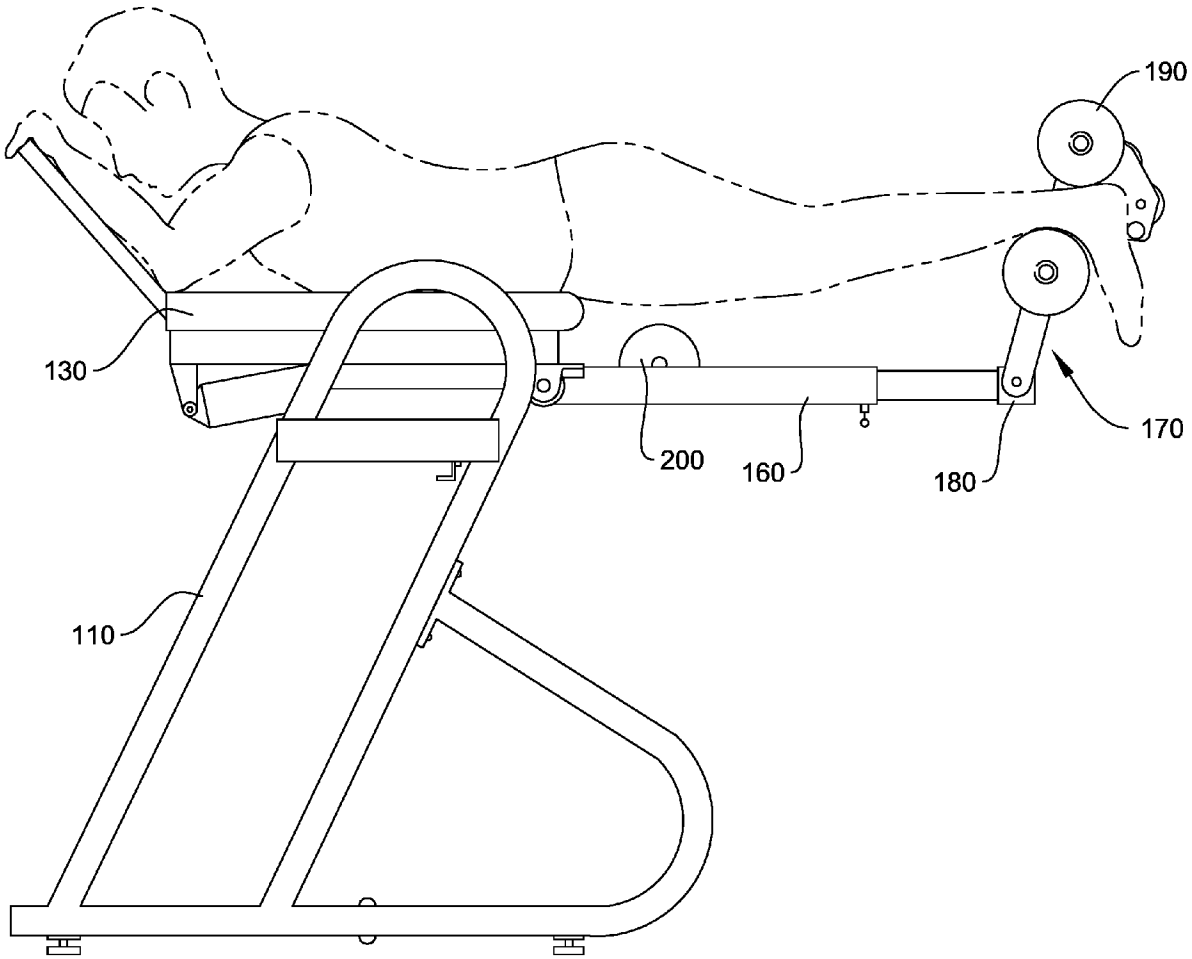

As shown in FIGS. 6-10, the resistance transfer apparatus 170 and its rotatable connection to the pendulum 160 permits the user's legs to move up to the horizontal and back past the vertical during the exercise. In this disclosure, the "vertical" position of a user's legs is substantially as depicted in FIG. 6. A "horizontal position of the user's legs is substantially as depicted in FIG. 8. A movement said to be "upward" or "upwardly" is a movement from the vertical position toward the horizontal position, and a movement said to be "downward" or "downwardly" is a movement from the horizontal position toward the vertical position. (Similar terms are used for the position of the pendulum 160). The static weight of pendulum 160 does not come into play or weight the user's ankles until the exercise is begun with the pendulum 160 vertical.

Figure 9:
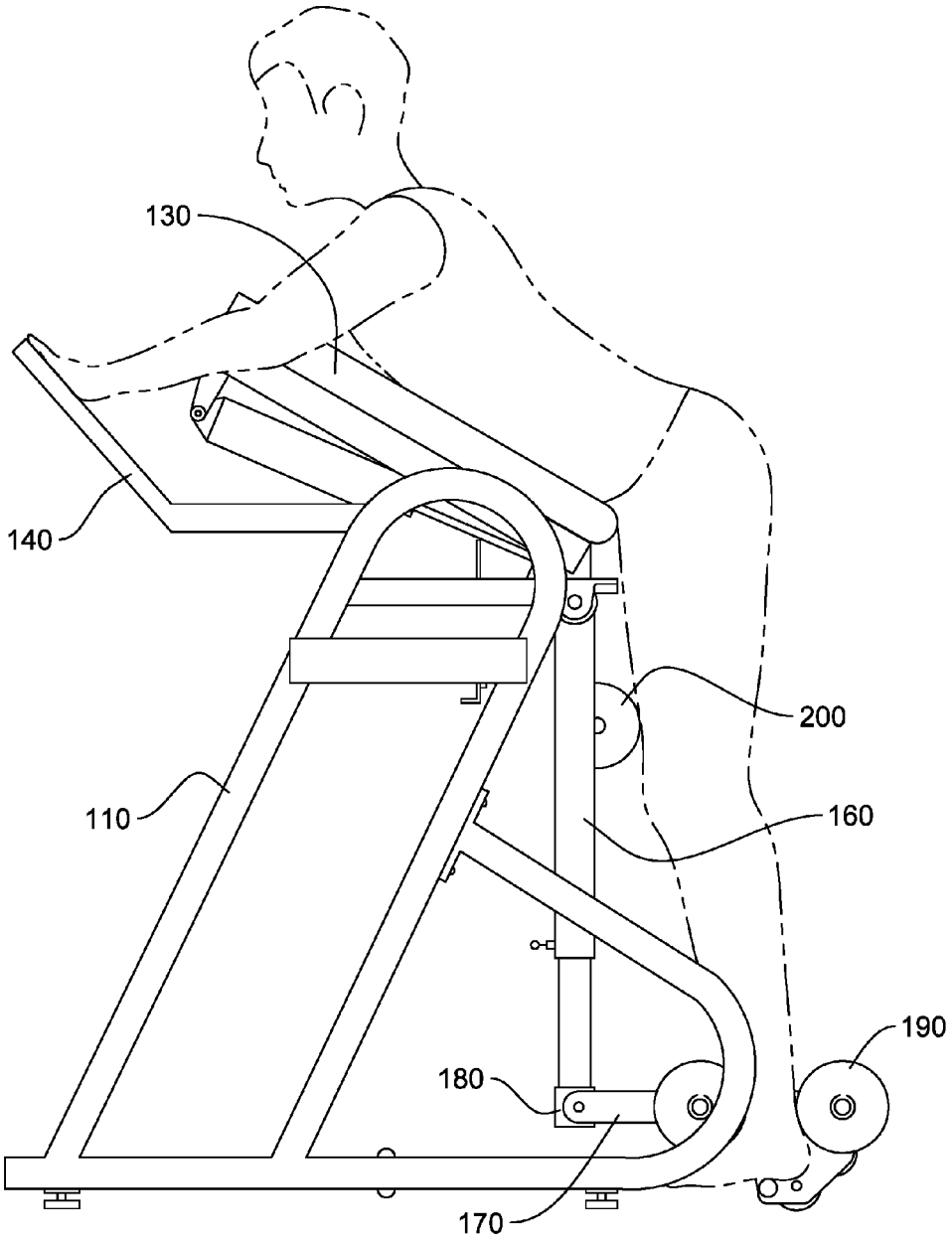
Figure 10:
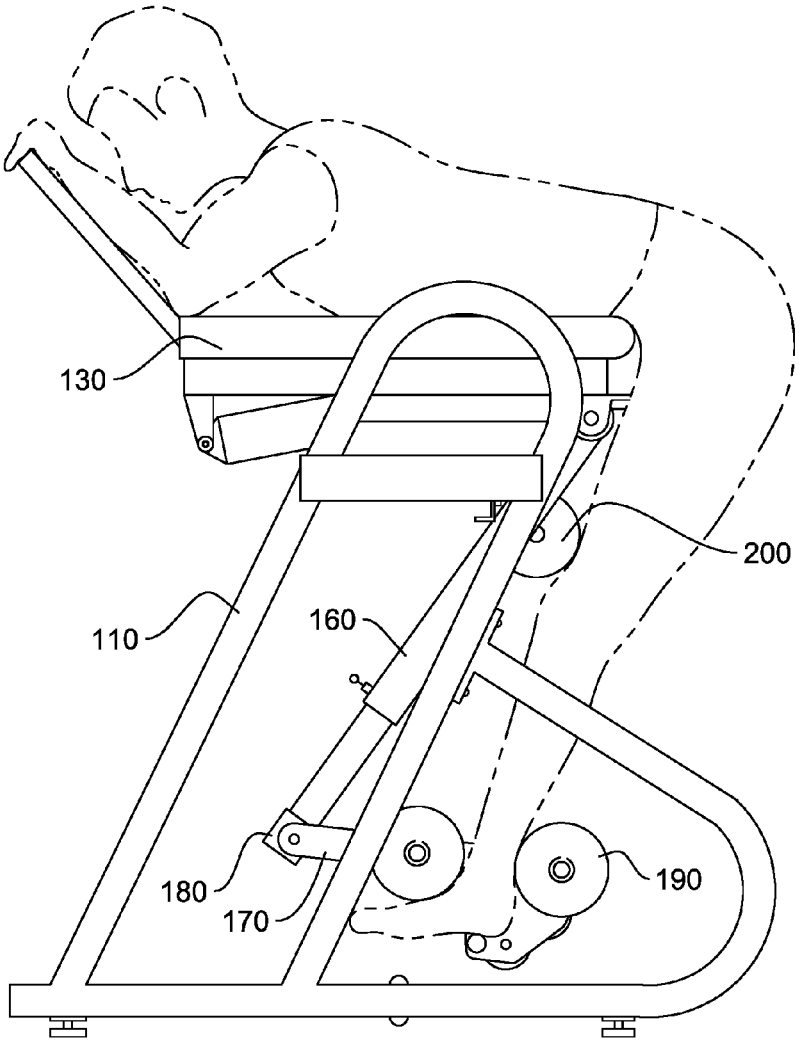

FIGS. 6-10 shown a cycle of exercise using an embodiment of the apparatus 100. FIG. 6 shows a starting position of the user's legs, engaging the resistance transfer apparatus 170. In FIGS. 7 and 8, the user has raised his or her legs to the approximately horizontal position. In FIG. 9, the user has lowered his or her legs back to the starting position and pushed slightly past the starting position of FIG. 6; thus the total range of motion is greater than 90 degrees. After the user has pushed the legs as far past the vertical as he or she can, the exercise begins again by contracting the muscles and pushing the legs back to the horizontal. Preferably, the range of motion allowed should be approximately at least 135 degrees. The exercise is then repeated the number of times desired. FIG. 10 illustrates an embodiment wherein the support platform 130 may be tilted by means of actuator 255 as shown in FIG. 1C, thus making it easier for a user to mount and start the exercise, also to dismount. Advantageously, the support platform 130 should allow a tilt of about 18 degrees.

The exercise is best performed as a smooth continuous action through the iterations. At all points in the exercise, the legs and correspondingly the affected muscles only push and are never pulled from one station to the next. The result is that hyperextension of muscles is avoided and the injured muscles of the lower back are permitted to receive an increase flow of blood. Additionally, in a user with an otherwise healthy lower back, the exercise builds up those lower back muscles thus avoiding future injury.

None of the description in this application should be read as implying that any particular element, step, or function is an essential element which must be included in the claim scope; the scope of patented subject matter is defined only by the allowed claims. Moreover, none of these claims are intended to invoke paragraph six of 35 U.S.C. Section 112 unless the exact words "means for" are used, followed by a gerund. The claims as filed are intended to be as comprehensive as possible, and no subject matter is intentionally relinquished, dedicated, or abandoned.

I claim:

1. An apparatus for lower back exercise, the apparatus comprising:

a support structure, the support structure further comprising a body support platform;

a pendulum, the pendulum pivotably connected to the support structure and depending therefrom;

a first actuator connected to the pendulum to cause the pendulum to move upwardly or downwardly to assist movement of the legs of a user engaging the pendulum;

a second actuator connected to the pendulum to exert resistance to movement of the pendulum initiated by the user; and controls operably connected to the first actuator and the second actuator effective to regulate the motion of the pendulum upwardly or downwardly while the user's body is disposed on the body support platform and the user's legs engage the pendulum.

2. The apparatus of claim 1 further comprising:

a resistance transfer apparatus pivotably connected to the pendulum.

3. The apparatus of claim 2 where the resistance transfer apparatus is pivotably attached to the pendulum at a connector.

4. The apparatus of claim 1 further comprising a support-platform actuator; the support-platform actuator connected to the body support platform to cause the body support platform to tilt relative to the support structure.

5. The apparatus of claim 1 where the first actuator comprises at least two actuators cooperating together.

6. The apparatus of claim 1, where the first and second actuators are pneumatic.

7. The apparatus of claim 6, where the controls comprise at least one gauge selectively displaying an amount of pneumatic pressure applied to one or both of the first and second actuators.

8. The apparatus of claim 1 where the first and second actuators are hydraulic.

9. The apparatus of claim 1 where the first and second actuators are electric motors.

10. The apparatus of claim 1 where the controls further comprise a first lever switch for continuously varying an amount of force applied by the first actuator; and a second lever switch for continuously varying an amount of force applied by the second actuator.

11. The apparatus of claim 1 where the range of motion of the pendulum is greater than 90 degrees.

12. An apparatus for lower back exercise, the apparatus comprising:

a support structure; the support structure further comprising a body support platform;

a pendulum, the pendulum pivotably connected to the support structure and depending therefrom; the pendulum having a plane of movement;

a resistance transfer apparatus pivotably connected to the pendulum; the resistance transfer apparatus pivoting in a plane substantially parallel to the plane of movement of the pendulum while engaging the legs of a user exercising;

at least one first actuator connected to the pendulum to cause the pendulum to move upwardly or downwardly to assist movement of the legs of the user engaging the pendulum;

a second actuator connected to the pendulum to cause the pendulum to move upwardly or downwardly to exert resistance to movement of the user's legs initiated by the user; and, controls operably connected to the at least one first actuator and the second actuator effective to regulate the motion of the pendulum upwardly or downwardly while the user's body is disposed on the body support platform and the user's legs engage the pendulum.

13. The apparatus of claim 12 further comprising a support-platform actuator; the support-platform actuator connected to the body support platform to cause the body support platform to tilt relative to the support structure.

14. The apparatus of claim 12, where the at least one first actuator and the second actuator are pneumatic.

15. The apparatus of claim 14, where the controls comprise at least one gauge selectively displaying the amount of pneumatic pressure applied to one or both of the first and second actuators.

16. The apparatus of claim 12 where the at least one first and the second actuators are hydraulic.

17. The apparatus of claim 12 where the at least one first and the second actuators are electric.

18. The apparatus of claim 12 where the controls further comprise a first lever switch for continuously varying an amount of force applied by the at least one first actuator; and a second lever switch for continuously varying an amount of force applied by the second actuator.

19. The apparatus of claim 12 where the range of motion of the pendulum is greater than 90 degrees.

* * * * *